US005993302A

United States Patent [19]

Chen et al.

[11] Patent Number: 5,993,302

[45] Date of Patent: Nov. 30, 1999

[54] CARRIER HEAD WITH A REMOVABLE RETAINING RING FOR A CHEMICAL MECHANICAL POLISHING APPARATUS

[75] Inventors: Hung Chen, San Jose; Steven M. Zuniga, Soquell, both of Calif.

[73] Assignee: Applied Materials, Inc., Santa Clara, Calif.

[21] Appl. No.: 09/002,213

[22] Filed: Dec. 31, 1997

[51] Int. Cl.[6] ..... B24B 29/00

[52] U.S. Cl. ..... 451/285; 451/41; 451/398

[58] Field of Search ..... 451/288, 287, 451/398, 285, 286, 41

[56] References Cited

U.S. PATENT DOCUMENTS

| | | | |
|---|---|---|---|
| 4,193,226 | 3/1980 | Gill, Jr. et al. . | |
| 4,373,991 | 2/1983 | Banks . | |
| 4,892,455 | 1/1990 | Hine . | |
| 4,900,212 | 2/1990 | Mikahara . | |
| 4,918,869 | 4/1990 | Kitta . | |
| 5,081,795 | 1/1992 | Tanaka et al. . | |
| 5,180,273 | 1/1993 | Sakaya et al. . | |
| 5,193,316 | 3/1993 | Olmstead . | |
| 5,205,082 | 4/1993 | Shendon et al. . | |
| 5,230,184 | 7/1993 | Bukhman . | |
| 5,409,348 | 4/1995 | Suzuki . | |
| 5,423,558 | 6/1995 | Koeth et al. . | |
| 5,423,716 | 6/1995 | Strasbaugh . | |
| 5,441,444 | 8/1995 | Nakajima . | |
| 5,443,416 | 8/1995 | Volodarsky et al. . | |
| 5,449,314 | 9/1995 | Meikle et al. . | |
| 5,449,316 | 9/1995 | Strasbaugh . | |
| 5,476,414 | 12/1995 | Hirose et al. . | |
| 5,498,199 | 3/1996 | Karlsrud et al. . | |
| 5,547,415 | 8/1996 | Hasegawa et al. . | |
| 5,584,751 | 12/1996 | Kobayashi et al. . | |
| 5,624,299 | 4/1997 | Shendon . | |
| 5,643,053 | 7/1997 | Shendon . | |
| 5,643,061 | 7/1997 | Jackson et al. | 451/289 |
| 5,681,215 | 10/1997 | Sherwood et al. | 451/388 |
| 5,791,978 | 8/1998 | Cesna et al. . | |
| 5,851,140 | 12/1998 | Barns et al. | 451/288 |

FOREIGN PATENT DOCUMENTS

| | | |
|---|---|---|
| 0 004 033 B1 | 9/1979 | European Pat. Off. . |
| 0 129 732 A1 | 1/1985 | European Pat. Off. . |
| 0 139 824 A2 | 5/1985 | European Pat. Off. . |
| 0 147 094 A2 | 7/1985 | European Pat. Off. . |
| 0156746 A1 | 10/1985 | European Pat. Off. . |
| 0 298 564 A1 | 1/1989 | European Pat. Off. . |
| 0 378 805 B1 | 7/1990 | European Pat. Off. . |
| 0 433 503 A1 | 6/1991 | European Pat. Off. . |
| 0 456 884 A2 | 11/1991 | European Pat. Off. . |
| 0 473 954 A1 | 3/1992 | European Pat. Off. . |
| 0 578 351 A1 | 1/1993 | European Pat. Off. . |
| 0 539 896 A1 | 5/1993 | European Pat. Off. . |
| 0 595 071 A1 | 5/1994 | European Pat. Off. . |
| 0653270 A1 | 5/1995 | European Pat. Off. . |
| 0 660 377 A1 | 6/1995 | European Pat. Off. . |
| 8631087 | 4/1987 | Germany . |
| 61-25768 | 2/1986 | Japan . |
| 2-243263 | 9/1987 | Japan . |
| 63-114870 | 5/1988 | Japan . |
| 63-300858 | 12/1988 | Japan . |
| 64-2857 | 1/1989 | Japan . |
| 1-155640 | 6/1989 | Japan . |
| 1-216768 | 8/1989 | Japan . |
| 1-303733 | 12/1989 | Japan . |
| 62-124844 | 6/1991 | Japan . |
| 4-171170 | 6/1992 | Japan . |
| WO94/19153 | 9/1994 | WIPO . |
| WO96/36459 | 11/1996 | WIPO . |

OTHER PUBLICATIONS

A. Mack, "Wafer Carrier, " IBM Technical Disclosure Bulletin, vol. 16, No. 9, Feb. 1974, 4 pgs.

(List continued on next page.)

*Primary Examiner*—David A. Scherbel
*Assistant Examiner*—Dung Van Nguyen
*Attorney, Agent, or Firm*—Fish & Richardson

[57] ABSTRACT

A carrier head for a chemical mechanical polishing apparatus includes a detachable retaining ring which may be used for centering the substrate during substrate loading.

32 Claims, 7 Drawing Sheets

OTHER PUBLICATIONS

Larson et al., "Electrostatic Cleaning and Polishing of Substrates," IBM Technical Disclosure Bulletin, vol. 26, No. 1, Jun. 1983, pp. 399–400.
Holley et al., "Mounting Method for Single–Side Polishing," IBM Technical Disclosure Bulletin, vol. 21, No. 10, Mar. 1979, 3 pgs.
Brun et al., "Process for Maintaining Wafer on Carrier During Single Side Polishing," IBM Technical Disclosure Bulletin, vol. 22, No. 6, Nov. 1979, 4 pgs.
Miklos, "Hand–Held Wafer–Handling Tool," IBM Technical Disclosure Bulletin, vol. 26, No. 8, Jan. 1984, 4 pgs.
Craft, "Modular Grind/Polish System", IBM Technical Disclosure Bulletin, vol. 26, No. 11, Apr. 1984, 2 pgs.
Pye et al., "High–density plasma CVD and CMP for 0.25–$\mu$m intermetal dielectric processing," Solid State Technology, Dec. 1995, 5 pgs.
Sivaram et al., "Planarizing Interlevel Dielectrics by Chemical–Mechnical Polishing," Solid State Technology, May 1992, pp. 87–91.
Kolenkow et al., "Chemical–Mechanical Wafer Polishing and Planarization in Batch Systems," Solid State Technology, Jun. 1992, pp. 112–114.
Jairath, et al., "Chemical–Mechanical Polishing: Process manufacturability," Solid State Technology, Jul. 1994, 4 pgs.
Martinez, "Chemical–Mechanical Polishing: Route to global planarization," Solid State Technology, May 1994, 3 pgs.
Iqbal et al., "Chemical–Mechanical Polishing of interlayer dielectric: A review," Solid State Technology, Oct. 1994, 4 pgs.
Heyboer et al., "Chemomechanical Silicon Polishing," Electrochem. Soc. vol. 138, No. 3, Mar. 1991, 2 pgs.
Patrick, et al., "Application of Chemical Mechanical Polishing to the Fabrication of VLSI Circuit Interconnections," Electrochem. Soc. vol. 138, No. 6, Jun. 1991, 7 pgs.
Poon et al., "A Manufacturable Chemical–Mechanical Polish Technology with a Novel Low–Permittivity Stop–Layer for Oxide Polishing," Advanced products Research and Development Laboratory, Motorola Inc., 8B–5, pp. 115–116.

PRESSURE REGULATOR
93b
98b
92b
90
96b
93c
98c
92c
PRESSURE REGULATOR
96c
99
COMPUTER
92a
98a
93a
PRESSURE REGULATOR
96a
76
70a
74
87
80
78
72
66
94a
94b
94c
100

CARRIER HEAD WITH A REMOVABLE RETAINING RING FOR A CHEMICAL MECHANICAL POLISHING APPARATUS

BACKGROUND

The present invention relates generally to chemical mechanical polishing of substrates, and more particularly to a carrier head for a chemical mechanical polishing apparatus.

Integrated circuits are typically formed on substrates, particularly silicon wafers, by the sequential deposition of conductive, semiconductive or insulative layers. After each layer is deposited, the layer is typically etched to create circuitry features. As a series of layers are sequentially deposited and etched, the outer or uppermost surface of the substrate, i.e., the exposed surface of the substrate, becomes increasingly non-planar. This non-planar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" pad or a fixed-abrasive pad. A standard pad has a durable roughened surface, whereas a fixed-abrasive pad has abrasive particles held in a containment media. The carrier head provides a controllable load, i.e., pressure, on the substrate to push it against the polishing pad. A polishing slurry, including at least one chemically-reactive agent, and abrasive particles, if a standard pad is used, is supplied to the surface of the polishing pad.

The carrier head usually includes a retaining ring. The retaining ring is positioned around the substrate to ensure that the substrate is held in a recess beneath the carrier head during polishing. The retaining ring may be affixed directly to the carrier head, or it may be connected to the carrier head by a flexible connector, such as a flexible membrane or bellows.

To conduct polishing, a substrate is loaded into the carrier head and positioned by the carrier head against the polishing pad. The loading operation typically occurs at a transfer station which includes centering equipment to align the substrate with the recess defined by the retaining ring.

One problem that has been encountered in CMP is that, in some carrier head designs, the retaining ring is free to pivot about a point located above the polishing pad surface. The pivoting action can lift one side of the retaining ring and lower the other side. This creates an uneven pressure distribution on the polishing pad, reducing the polishing uniformity.

Another problem is that the retaining ring needs to be periodically replaced. However, the retaining ring may be difficult to replace, requiring complete disassembly of the carrier head.

SUMMARY

In one aspect, the invention is directed to a carrier head for a chemical mechanical polishing apparatus. The carrier head comprises a housing having a recess, a substrate-receiving surface, and a retaining ring releasably positionable in the recess to surround the substrate-receiving surface. A seal slidably engages the retaining ring to form a pressurizable chamber between the housing and the retaining ring when the retaining ring is positioned in the recess.

In another aspect, the carrier head comprises a housing having a recess, a substrate-receiving surface, a retaining ring releasably positionable in the recess to surround the substrate-receiving surface, and an evacuable chamber formed between the housing and the retaining ring when the retaining ring is positioned in the recess. A pressure within the chamber may be selected either to maintain the retaining ring in the recess or to release the retaining ring from the housing.

In another aspect, the carrier comprises a housing including a main body portion and a substantially annular flange surrounding the main body portion to define a recess, a substrate-receiving surface, a laterally movable retaining ring positionable in the recess so that the retaining ring surrounds the substrate-receiving surface, and a seal to form a pressurizable chamber between the housing and the retaining ring. The main body portion has an outwardly-projecting annular rim, and the retaining ring contacts the annular rim contacts during polishing.

In another aspect, the carrier head comprises a housing having a recess, a substrate-receiving surface, a releasable retaining ring positionable in the recess to surround the substrate-receiving surface, and a seal to form an evacuable chamber between the housing and the retaining ring when the retaining ring is positioned in the recess without mechanically securing the retaining ring to the carrier head.

Implementations of the invention may include the following. The substrate-receiving surface may be a flexible membrane coupled to the housing to form a second pressurizable chamber. The seal may include four O-rings. The first two O-rings may contact inner and outer surfaces of the retaining ring, and the other two O-rings are positioned between the housing and the first two O-rings. The annular rim may be adjacent an opening to the recess, and located sufficiently close to a polishing surface to reduce torque applied to the retaining ring.

In another aspect, the invention is directed to a retaining ring. The retaining ring comprises a bottom surface for contacting a polishing pad, an inner surface for holding a substrate beneath a carrier head, and a tapered top surface including an inwardly sloped portion for guiding the substrate into a recess defined by the inner surface and the polishing pad.

In another aspect, the invention is directed to a method of loading a substrate into a carrier head. A carrier head having a recess, a substrate-receiving surface, and a releaseable retaining ring is positioned over a support surface. The retaining ring is released from the carrier head so that it is supported on the support surface, and the carrier head is moved away from the support surface. A substrate is positioned into a recess defined by the retaining ring and the support surface, and the carrier head is moved to a position such that the substrate mounting surface contacts the substrate within the recess.

Implementations of the invention may include the following. The support surface may be a polishing pad, and the substrate and/or the retaining ring may be loaded against the polishing pad during polishing. The support surface may be located in a transfer station, and the substrate and/or the retaining ring may be vacuum-chucked to the carrier head. The substrate may be positioned by locating the substrate over the recess using a robot arm and releasing the substrate from the robot arm. The substrate may be centered by a tapered upper surface of the retaining ring as the substrate descends into the recess. The retaining ring may be released by increasing a pressure in a chamber between the retaining ring and a housing to force the retaining ring from the carrier head, or by discontinuing a vacuum-chucking operation which holds the retaining ring to the carrier head.

Advantages of the invention include the following. The retaining ring pivots such that polishing uniformity is substantially improved. In addition, the retaining ring is relatively easy to remove and replace. The centering equipment at the transfer station may be replaced with a simple support surface, or the entire transfer station may be eliminated, thereby reducing the cost and complexity of the CMP apparatus.

Other advantages and features of the invention will become apparent from the following description, including the drawings and claims.

DETAILED DESCRIPTION

Figure 1:
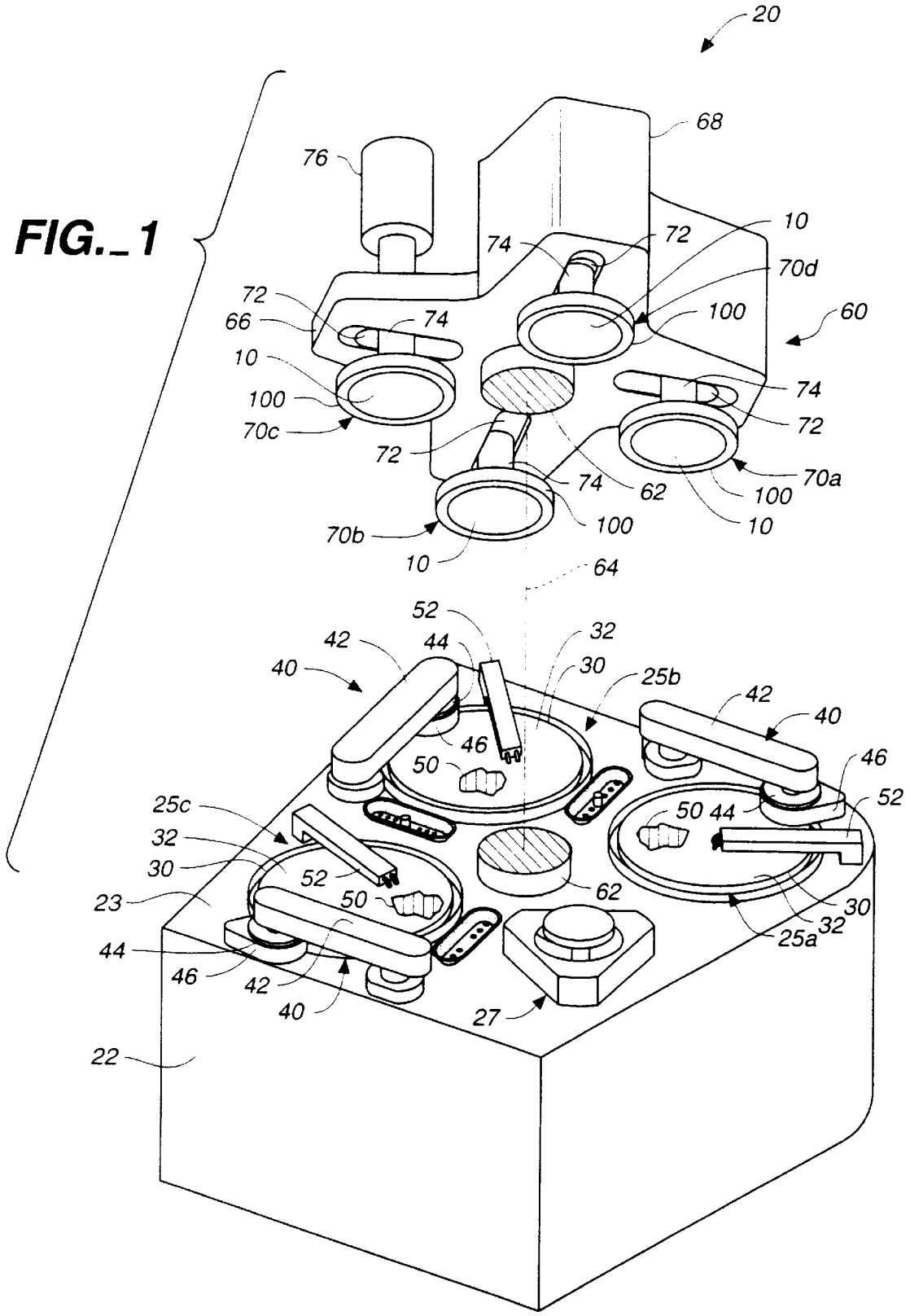
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus 20 may be found in pending U.S. application Ser. No. 08/549,336, by Perlov, et al., filed Oct. 27, 1995, entitled CONTINUOUS PROCESSING SYSTEM FOR CHEMICAL MECHANICAL POLISHING, assigned to the assignee of the present invention, the entire disclosure of which is hereby incorporated by reference.

The CMP apparatus 20 includes a lower machine base 22 with a table top 23 mounted thereon and a removable upper outer cover (not shown). Table top 23 supports a series of polishing stations 25*a*, 25*b* and 25*c*, and a transfer station 27. Transfer station 27 may form a generally square arrangement with the three polishing stations 25*a*, 25*b* and 25*c*. Transfer station 27 serves multiple functions of receiving individual substrates 10 from a loading apparatus (not shown), washing the substrates, loading the substrates into the carrier heads (to be described below), receiving the substrates from the carrier heads, washing the substrates again, and finally transferring the substrates back to the loading apparatus.

Each polishing station 25*a*–25*c* includes a rotatable platen 30 on which is placed a polishing pad 32. If substrate 10 is an eight-inch (200 millimeter) diameter disk, then platen 30 and polishing pad 32 will be about twenty inches in diameter. Platen 30 may be connected by a platen drive shaft (not shown) to a platen drive motor (also not shown).

Each polishing station 25*a*–25*c* may further include an associated pad conditioner apparatus 40. Each pad conditioner apparatus 40 has a rotatable arm 42 holding an independently rotating conditioner head 44 and an associated washing basin 46. The conditioner apparatus maintains the condition of the polishing pad so that it will effectively polish any substrate pressed against it while it is rotating.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60, including a carousel support plate 66 and a cover 68, is positioned above lower machine base 22. Carousel support plate 66 is supported by a center post 62 and rotated thereon about a carousel axis 64 by a carousel motor (not shown) located within machine base 22. Multi-head carousel 60 includes four carrier head systems 70*a*, 70*b*, 70*c*, and 70*d* mounted on carousel support plate 66 at equal angular intervals about carousel axis 64. Three of the carrier head systems receive and hold substrates, and polish them by pressing them against polishing pads of polishing stations 25*a*–25*c*. One of the carrier head systems receives a substrate from and delivers the substrate to transfer station 27. The carousel motor may orbit carrier head systems 70*a*–70*d*, and the substrates attached thereto, about carousel axis 64 between the polishing stations and the transfer station.

Each carrier head system 70*a*–70*d* includes a polishing or carrier head 100. Each carrier head 100 independently rotates about its own axis, and independently laterally oscillates in a radial slot 72 formed in carousel support plate 66 (see also FIG. 2). A carrier drive shaft 74 extends through a drive shaft housing 78 (see FIG. 3) to connect a carrier head rotation motor 76 to carrier head 100 (shown in FIG. 1 by the removal of one-quarter of cover 68). There is one carrier drive shaft and motor for each head.

Figure 2:
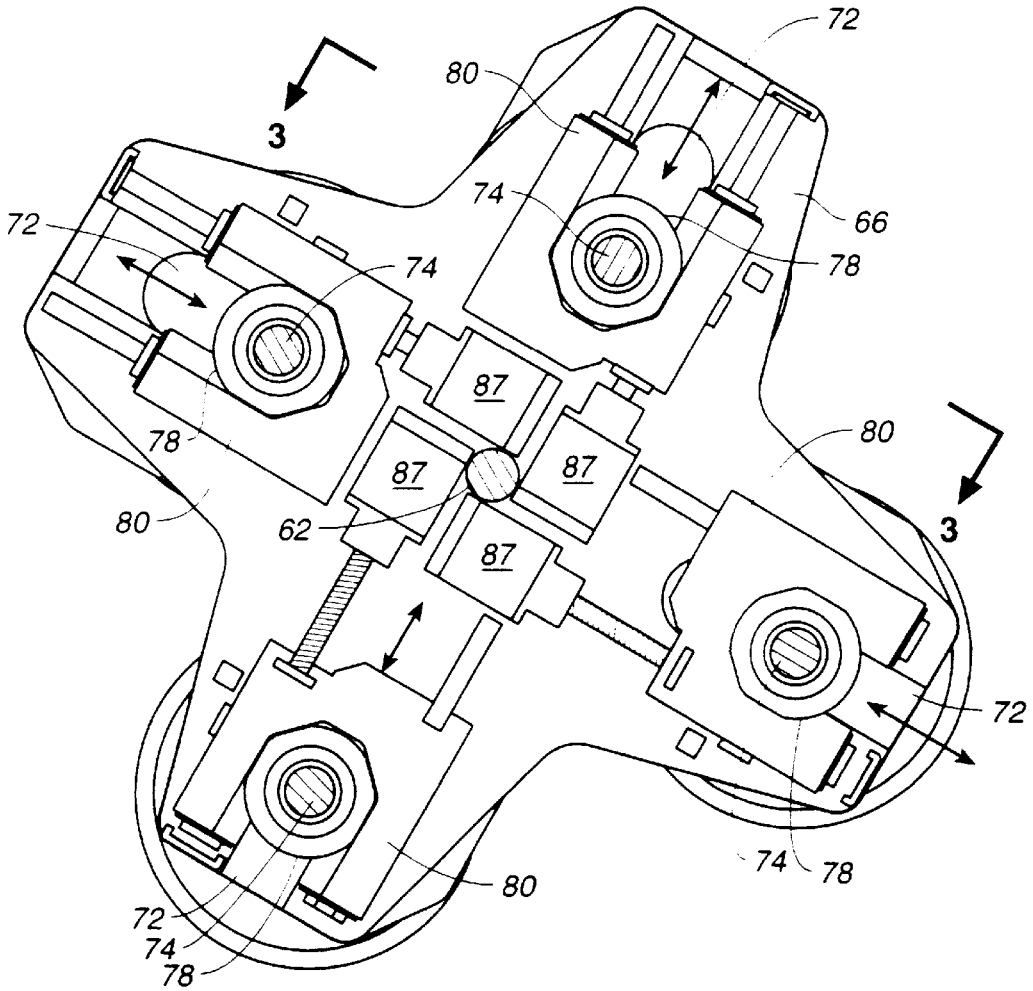
FIG. 2 is a schematic top view of a carousel, with the upper housing removed.

Referring to FIG. 2, in which cover 68 of carousel 60 has been removed, the top of carousel support plate 66 supports four slotted carrier head support slides 80. Each slide 80 is aligned with one of radial slots 72 and may be driven along the slot by a radial oscillator motor 87. The four motors 87 are independently operable to independently move the four slides along radial slots 72 in carousel support plate 66.

Figure 3:
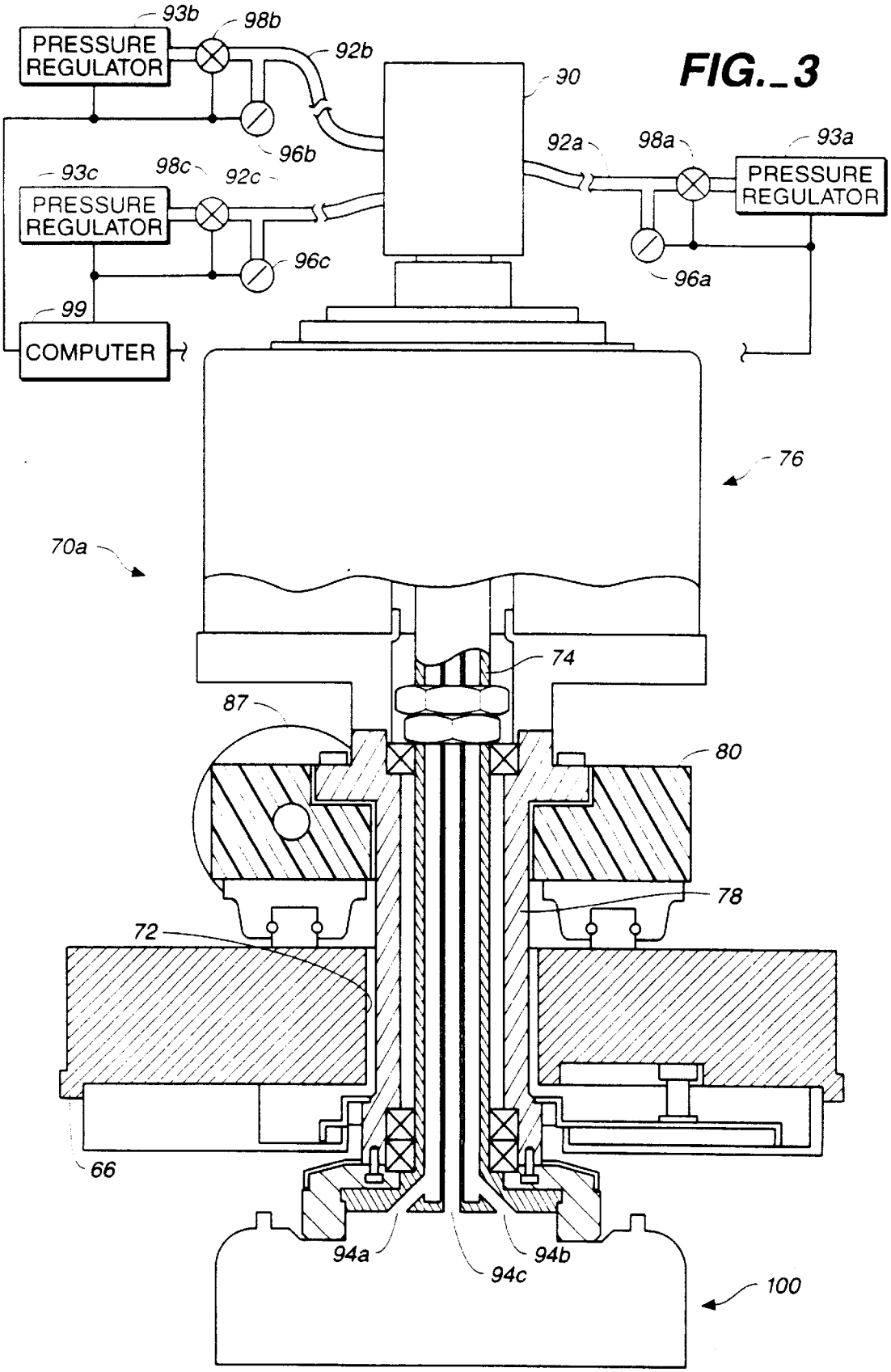
FIG. 3 is partially a cross-sectional view of the carousel of FIG. 2 along line 3—3, and partially a schematic diagram of the pressure regulators used by the chemical mechanical polishing apparatus.

Referring to FIG. 3, a rotary coupling 90 at the top of drive motor 76 couples three or more fluid lines 92*a*, 92*b* and 92*c* to three or more channels 94*a*, 94*b* and 94*c*, respectively, in drive shaft 74. Three vacuum or pressure sources 93*a*, 93*b* and 93*c*, such as pumps, venturis or pressure regulators (hereinafter referred to simply as "pumps"), may be connected to fluid lines 92*a*, 92*b* and 92*c*, respectively. Three pressure sensors or gauges 96*a*, 96*b* and 96*c* may be connected to fluid lines 92*a*, 92*b* and 92*c*, respectively, and control valves 98*a*, 98*b* and 98*c* may be connected across the fluid lines 92*a*, 92*b* and 92*c*, respectively. Pumps 93*a*–93*c*, pressure gauges 96*a*–96*c* and control valves 98*a*–98*c* are appropriately connected to a general-purpose digital computer 99. Computer 99 may operate pumps 93*a*–93*c* to pneumatically power carrier head 100.

During actual polishing, three of the carrier heads, e.g., those of carrier head systems 70*a*–70*c*, are positioned at and above respective polishing stations 25*a*–25*c*. Each carrier head 100 lowers a substrate into contact with a polishing pad. As noted, slurry 50 acts as the media for chemical mechanical polishing of the substrate.

Generally, carrier head 100 holds the substrate in position against the polishing pad and distributes a force across the back surface of the substrate. The carrier head also transfers torque from the carrier head drive shaft to the substrate.

Figure 4:
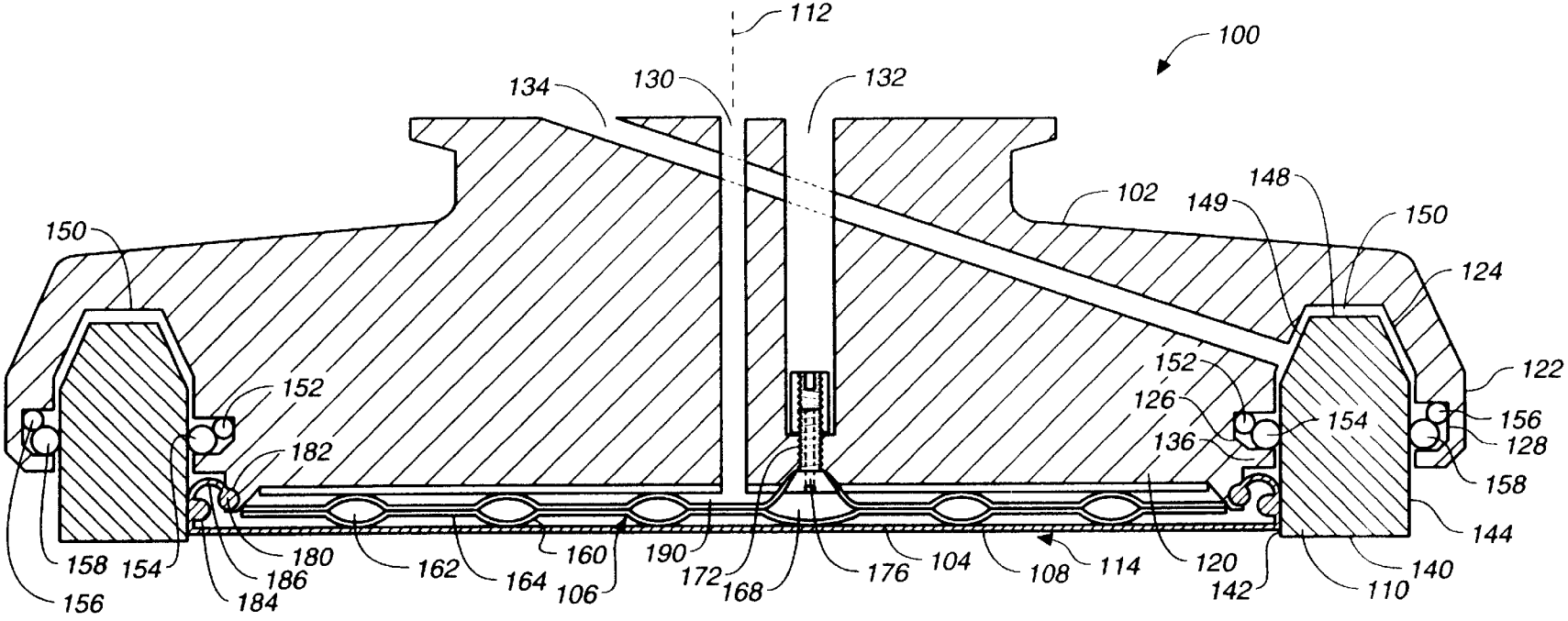
FIG. 4 is a schematic cross-sectional view of a carrier head.

Referring to FIG. 4, carrier head 100 includes a housing 102, a flexible member or membrane 104, a compliant backing member 106, and a retaining ring 110. The housing 102 is connectable to drive shaft 74 to rotate therewith during polishing about an axis of rotation 112, which is substantially perpendicular to the surface of the polishing pad. The flexible membrane 104 may be connected to housing 102 and may extend below the housing to provide a mounting surface 108 for a substrate. The retaining ring 110 holds the substrate beneath mounting surface 108 during polishing. The compliant backing member 106 provides a corrugated or bumpy surface to enable chucking of the substrate to the carrier head.

The housing 102 is generally circular in shape to correspond to the circular configuration of the substrate to be polished. The housing includes a generally cylindrical main body portion 120 and an annular flange portion 122 which extends around the main body portion to form a generally U-shaped gap 124. Inner and outer annular recesses 126 and 128 may be formed in the outer surface of main body portion 120 and the inner surface of flange portion 122, respectively, on opposing sides of gap 124. The inner and outer annular recesses will hold a sealing mechanism to seal the retaining ring to the housing.

Retaining ring 110 is positionable in gap 124 between main body portion 120 and flange portion 122. Retaining ring 110 is a generally annular ring having a bottom surface 140 to contact the polishing pad. The bottom surface 140 may be substantially flat, or it may have grooves or channels to permit slurry to reach the substrate during polishing. An inner surface 142 of retaining ring 110 defines, in conjunction with mounting surface 108 of flexible membrane 104, a substrate receiving recess 114. The retaining ring 110 holds the substrate in substrate receiving recess 114 and transfers the lateral load from the substrate to the housing. A top surface 148 of the retaining ring is tapered to permit the retaining ring to fit into gap 124. The top surface includes an inwardly sloped portion 149.

Figure 5:
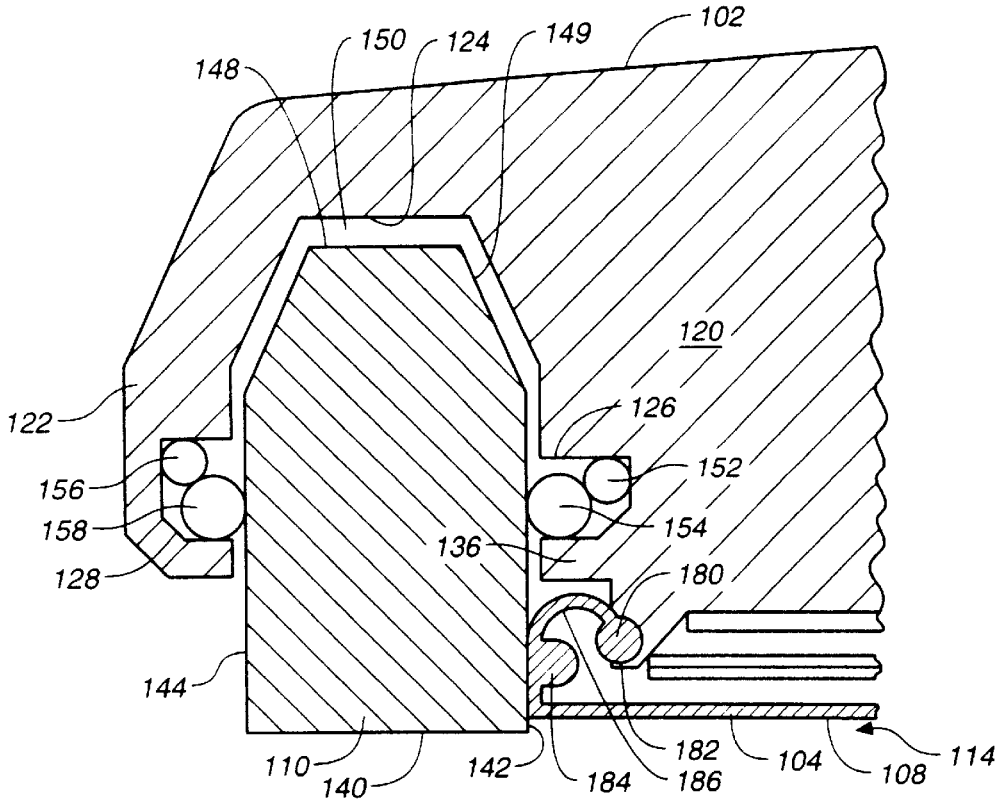
FIG. 5 is an enlarged view of a portion of the carrier head of FIG. 4.

Referring to FIG. 5, during polishing operations, retaining ring 110 is positioned in gap 124 between main body portion 120 and flange portion 122 of housing 102. O-rings may be used to provide a slidable seal between retaining ring 110 and housing 102. The O-rings also form a pressurizable chamber 150 between retaining ring 110 and housing 102. Two O-rings 152 and 154 may be located in inner recess 126, and two more O-rings 156 and 158 may be located in outer recess 128. In each recess, one O-ring may be more compressible than the other O-ring. O-ring 152 may be more compressible than O-ring 154, and similarly, O-ring 156 may be more compressible than O-ring 158. The O-ring 154 slidably engages inner surface 142 of retaining ring 110, and O-ring 152 seals the space between O-ring 154 and main body portion 120, whereas O-ring 158 slidably engages an outer surface 144 of retaining ring 110, and O-ring 156 seals the space between O-ring 158 and flange portion 122. The O-ring assembly allows retaining ring 110 to move vertically while maintaining a fluid-tight seal between the retaining ring and the housing. In addition, the O-ring assembly allows retaining ring 110 to move laterally while providing the seal between the retaining ring and the housing.

The O-rings engage the retaining ring tightly enough to permit chamber 150 to be pressurized or evacuated, as necessary. However, as noted, the O-rings are sufficiently loose to permit vertical motion by the retaining ring. The frictional force between the O-rings and the retaining ring may be such that the retaining ring is held within gap 124 when the carrier head is lifted off the polishing pad. In this case, the retaining ring is removed from gap 124 by manually pulling it out of the gap or by forcing it out of the gap by increasing the pressure within chamber 150. Alternately, the frictional forces between the O-rings and the retaining ring may be insufficient to hold the retaining ring within gap 124 when the carrier head is lifted. In this case, the retaining ring is vacuum-chucked to the carrier head by evacuating chamber 150.

The pump 93*a* (see FIG. 3) may be connected to chamber 150 via fluid line 92*a*, rotary coupling 90, channel 94*a* in drive shaft 74, and a passage 134 (see FIG. 4) in housing 102. A fluid, e.g. a gas, such as air, is pumped into and out of chamber 150 to control the load applied to retaining ring 110. When fluid is pumped into chamber 150, retaining ring 110 is pushed downwardly. On the other hand, if fluid is removed from chamber 150, the chamber volume will decrease as retaining ring 110 is drawn upwardly. Thus, chamber 150 may be used to apply an adjustable load to the polishing pad and to control the vertical position of the retaining ring. In addition, by evacuating chamber 150, the retaining ring may be vacuum-chucked to the carrier head.

During polishing, frictional forces from the polishing pad tend to force the retaining ring toward the leading side of carrier head, i.e., in the same direction as the rotation of the polishing pad. This forces one side of inner surface 142 of retaining ring 110 against an annular rim 136 which projects horizontally from main body portion 120 of housing 102. The point of contact between annular rim 136 and retaining ring 110 becomes the point about which the retaining ring pivots. Since this pivot point is located near the polishing pad surface at the leading edge of the retaining ring, less torque is applied to the retaining ring. Therefore, the retaining ring is more stable and the downward pressure generated by the chamber is distributed more uniformly across the bottom surface of the retaining ring.

It may be noted that retaining ring 110 is held in gap 124 by frictional forces or by vacuum-chucking rather than by being mechanically secured by means of bolts or screws, an adhesive, a flexible connector, or a stop piece. Thus, replacing the retaining ring is more convenient. As discussed, depending on the frictional forces between the O-rings and the retaining ring, the retaining ring may simply be pulled out of gap 124, or it may be forced out of gap 124 by increasing the pressure in chamber 150. Alternately, in the case where the retaining ring is vacuum-chucked to the carrier head, it may be released by discontinuing the chucking operation.

Returning to FIG. 4, backing member 106 is secured below housing 102. The backing member 106 has a corrugated or bumpy lower surface 160. Specifically, the backing member may be formed of a compliant material having a regular array of bumps and corresponding indents. For example, the backing member may include an array of air pockets or inflatable cells 162 connected by interstitial regions 164. The cells 162 may be fluidly connected by channels (not shown) to form a single cavity 168 in the backing member. The cells provide the raised regions of the lower surface, whereas the interstitial regions between the cells provide the valleys in the lower surface.

A more complete description of backing member 106 and its method of use may be found in the concurrently filed application entitled A CARRIER HEAD INCLUDING A FLEXIBLE MEMBRANE AND A COMPLIANT BACKING MEMBER FOR A CHEMICAL MECHANICAL POLISHING APPARATUS, by Zuniga et al., Express Mail Label EM202539924US, assigned to the assignee of the present invention, the entire disclosure of which is hereby incorporated by reference.

To attach backing member 106 to housing 102, screws or bolts (not shown) may extend through apertures (also not shown) in the interstitial regions near the periphery of the backing member and into receiving recesses (again, not shown) in the housing. In addition, a threaded screw 172 with a channel 176 through the center thereof may connect one of the cells a to passage 132 through housing 102.

The pump 93*b* (see FIG. 3) may be connected to cavity 168 via fluid line 92*b*, rotary coupling 90, channel 94*b* in drive shaft 74, and passage 132 in housing 102. If pump 93*b* directs a fluid, e.g., a gas, such as air, into cavity 168, the backing member will be inflated and will expand. On the other hand, if pump 93*b* evacuates cavity 168, the backing member will contract.

Flexible membrane 104 may be a generally circular sheet formed of a flexible and elastic material, such as chloroprene or ethylene propylene rubber. A protruding edge 180 of flexible membrane 104 (see FIGS. 4 and 5) may fit into annular groove 182 in the outer cylindrical surface of main body portion 120 of housing 102. The flexible membrane 104 may also include a thick annular portion 184, located generally adjacent the retaining ring, to keep the mounting surface generally taut. A portion 186 of the flexible membrane extends inwardly from thick portion 184 to protruding edge 180.

During polishing, substrate 10 is positioned in substrate receiving recess 114 with the backside of the substrate positioned against mounting surface 108 of flexible membrane 104. The space between flexible membrane 104 and housing 102 defines a chamber 190. Pump 93*c* (see FIG. 3) may be connected to chamber 190 via fluid line 92*c*, rotary coupling 90, channel 94c in drive shaft 74, and passage 130 in housing 102. If pump 93*c* directs a fluid, e.g., a gas, such as air, into chamber 190, then flexible membrane 104 is forced downwardly. Thus, pressurization of chamber 190 presses the substrate against the polishing pad. On the other hand, if pump 93*c* evacuates chamber 190, then the membrane is drawn upwardly.

Retaining ring 110 may be used to center the substrate during loading into the carrier head. As described in greater detail below, this may permit the CMP apparatus to function without a transfer station. Alternately, loading of the substrate may still occur at a transfer station, but the centering mechanism in the transfer station can be eliminated.

Figure 6A:
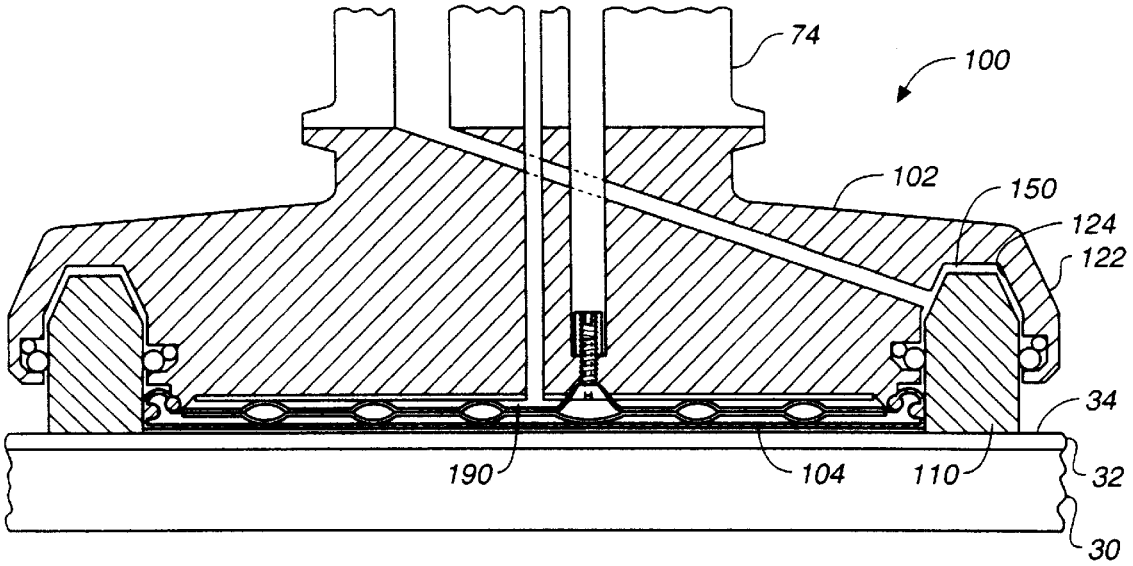
FIGS. 6A–6E are schematic cross-sectional views illustrating a method of loading a substrate into the carrier head of FIG. 4.

Referring to FIG. 6A, carrier head 100 is initially over polishing pad 32 with retaining ring 110 in contact with polishing surface 34. Fluid is directed into chamber 150 in order to force retaining ring 110 down, and housing 102 is lifted away from the polishing pad 32, e.g., by a pneumatic actuator (not illustrated) at the upper end of the drive shaft.

Figure 6B:
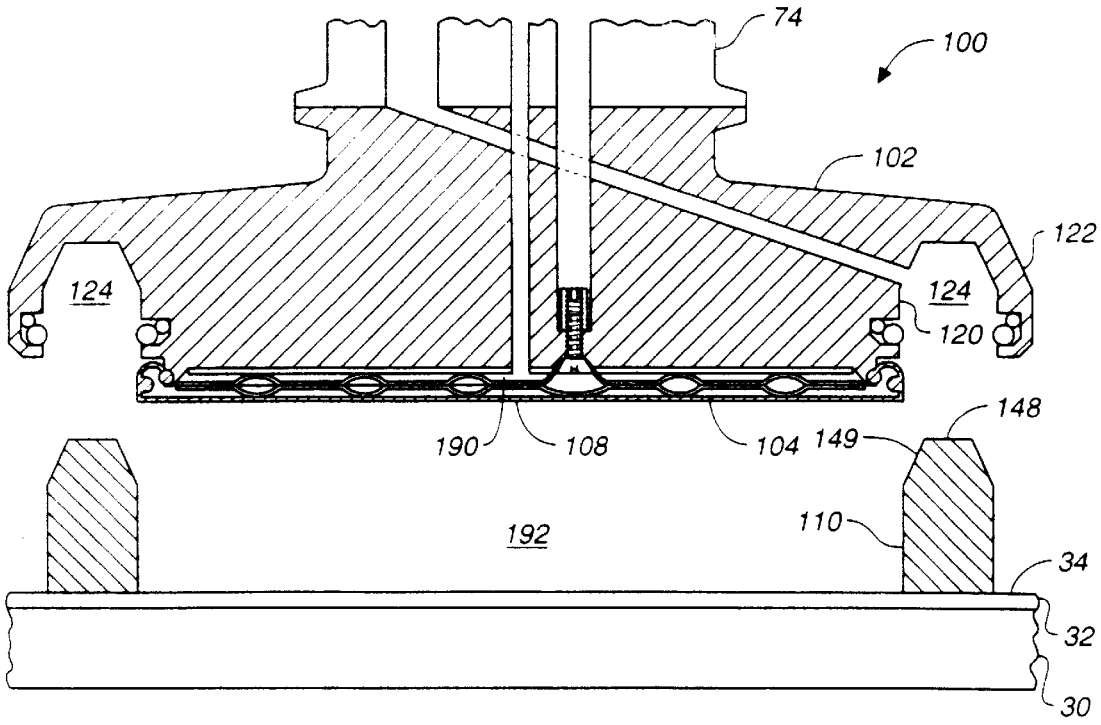

Thus, referring to FIG. 6B, when housing 102 is lifted away from the polishing pad, retaining ring 110 remains on the pad. As such, the volume inside the inner surface of the retaining ring defines a substrate-receiving recess 192 over the polishing pad.

Figure 6C:
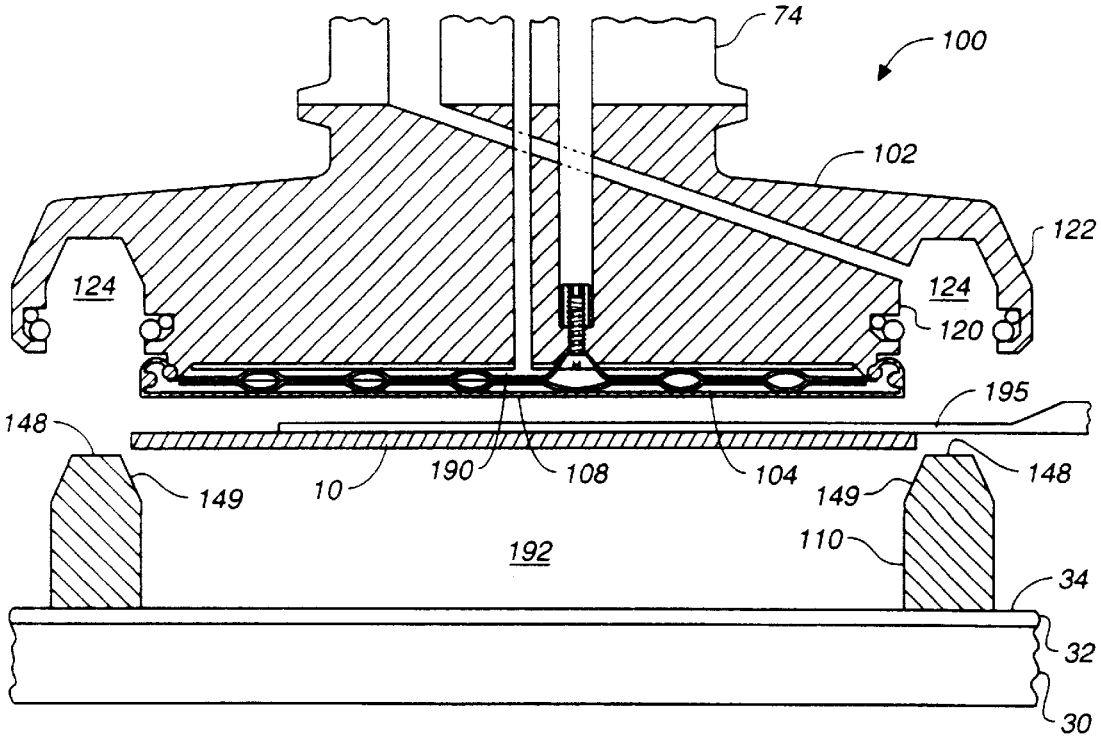

Referring to FIG. 6C, a robot arm 195 carries a substrate 10, e.g., by means of a vacuum attachment, so that it is positioned generally above substrate receiving recess 192. Robot arm 195 need not exactly center the substrate within the substrate receiving recess; a reasonable margin of error is permitted. The vacuum supply to robot arm 195 is deactivated so that the substrate detaches from the robot arm and is guided into substrate receiving recess 192 by means of inwardly sloped portion 149 of tapered top surface 148.

Figure 6D:
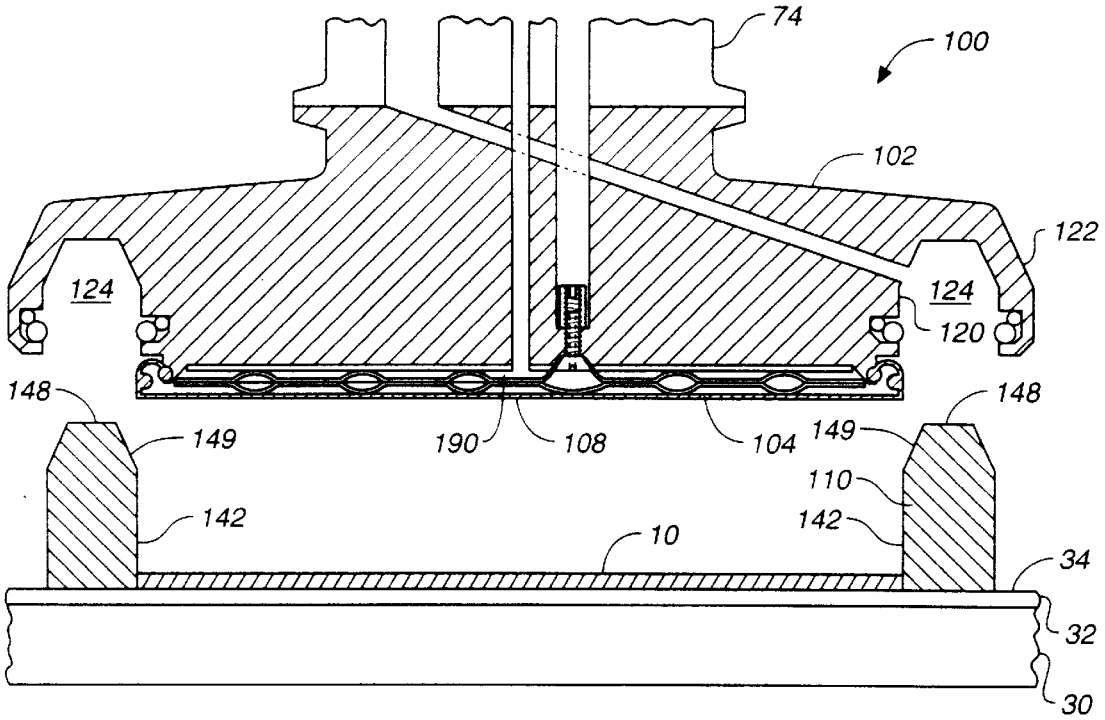

Thus, referring to FIG. 6D, after robot arm 195 is withdrawn, the substrate has been properly centered by the retaining ring.

Figure 6E:
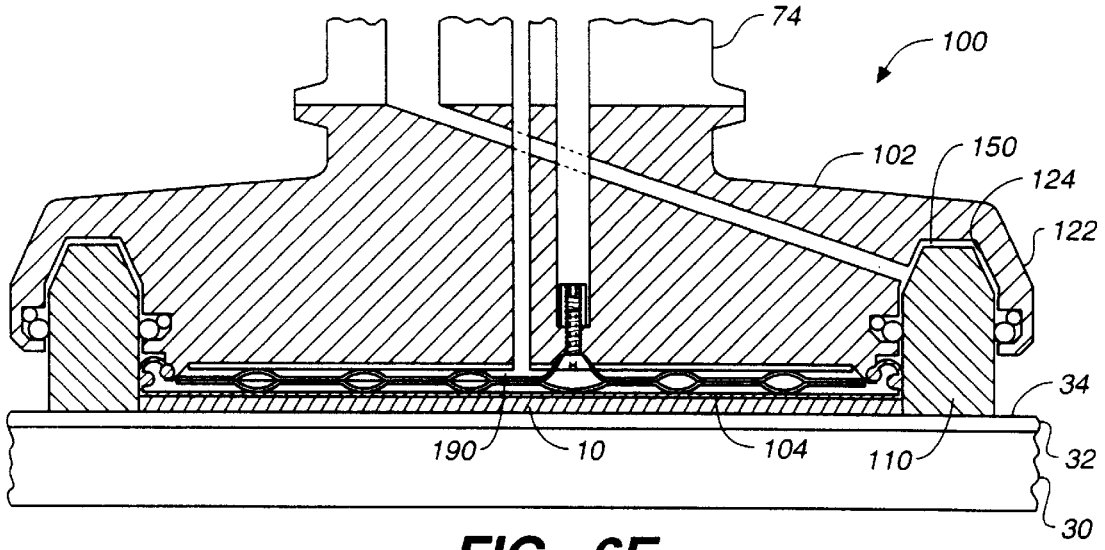

Referring to FIG. 6E, after the substrate is positioned in substrate receiving recess 192, housing 102 is lowered, e.g., by the pneumatic actuator, so that retaining ring 110 is inserted into gap 124. Then fluid is directed into chamber 190 to apply a downward load to the substrate for the polishing step. In addition, pump 93*a* may pump a fluid into chamber 150 to control the load applied by retaining ring 10 to the substrate.

To remove the substrate from the polishing pad, fluid is directed into cavity 168 of backing member 106. This causes backing member 106 to expand so that its lower surface contacts an upper surface of flexible membrane 104. Then chamber 190 is evacuated to vacuum-chuck the substrate to the mounting surface. Specifically, the evacuation of the chamber creates low pressure pockets between the backing member and the flexible membrane which hold the substrate against the mounting surface. Finally, the carrier head is lifted off the polishing pad. As previously noted, depending on the frictional forces between the O-rings and retaining ring, chamber 150 can also be evacuated so that retaining ring 110 is vacuum-chucked to the carrier head when it is lifted off the polishing pad. Alternately, the retaining ring may be left on the polishing pad for use with the next substrate, either by not vacuum-chucking the retaining ring or by increasing the pressure in chamber 150.

As discussed, detachable retaining ring 110 permits a substrate to be loaded into the carrier head without the use of complex and expensive substrate transfer equipment. Specifically, the substrate can be loaded into the carrier head at the polishing pad, and the transfer station may be eliminated, resulting in a significant reduction in the cost and size of the CMP apparatus. Alternately, the centering equipment at the transfer station may be replaced with a simple support surface. In this case, the loading process would proceed as discussed with reference to FIGS. 6A–6E, except that a support surface at the transfer station would be used in place of a polishing surface at the polishing station. In addition, the carrier head would be transferred from the transfer station to a polishing station after the loading procedure.

The present invention has been described in terms of a number of preferred embodiments. The invention, however, is not limited to the embodiments depicted and described. Rather, the scope of the invention is as defined by the appended claims.

What is claimed is:

1. A carrier heads comprising:

a housing having a recess;

a substrate-receiving surface;

a retaining ring positionable in the recess to surround the substrate-receiving surface; and a seal to engage the retaining ring to form a chamber between the housing and the retaining ring when the retaining ring is positioned in the recess, the retaining ring being releasable and separable from the housing by control of a pressure in the chamber.

2. The carrier head of claim 1 wherein the substrate-receiving surface comprises a flexible membrane coupled to the housing to form a second chamber therebetween.

3. The carrier head of claim 1 wherein the seal comprises at least one O-ring.

4. The carrier head of claim 1 wherein the seal includes first and second inner O-rings, and first and second outer O-rings, and wherein the first O-rings are less compressible than the second O-rings.

5. The carrier head of claim 4 wherein the first inner O-ring and the first outer O-ring contact inner and outer surfaces of the retaining ring, respectively, and the second inner O-ring and the second outer O-ring are positioned between the housing and the first inner O-ring and the first outer O-ring, respectively.

6. The carrier head of claim 5 wherein the housing includes a main body portion and a substantially annular flange surrounding the main body portion to form the recess, and the inner O-rings are substantially positioned in an inner indentation in an outer surface of the main body portion and the outer O-rings are substantially positioned in an annular outer indentation in an inner surface of the flange.

7. The carrier head of claim 1 wherein the housing includes a main body portion and a substantially annular flange surrounding the main body to form the recess.

8. The carrier head of claim 7 wherein the main body portion includes an outwardly-projecting annular rim which contacts a portion of the retaining ring during polishing.

9. The carrier head of claim 1 wherein the retaining ring includes a tapered top surface.

10. The carrier head of claim 1 wherein the recess is substantially annular and the retaining ring is substantially ring-shaped.

11. The carrier head of claim 1 wherein the retaining ring is not mechanically secured to the carrier head.

12. A carrier heads comprising:

a housing having a recess;

a substrate-receiving surface;

a retaining ring releasably positionable in the recess to surround the substrate-receiving surface; and an evacuable chamber formed between the housing and the retaining ring when the retaining ring is positioned in the recess, wherein a pressure within the chamber may be controlled to maintain the retaining ring in the recess or to release and separate the retaining ring from the housing.

13. A method of loading a substrate into a carrier head, comprising:

positioning a carrier head over a support surface, the carrier head having a releasable retaining ring and a substrate mounting surface;

releasing the retaining ring from the carrier head so that the retaining ring is supported on the support surface;

moving the carrier head away from the support surface;

positioning a substrate into a recess defined by the retaining ring and the support surface; and moving the carrier head to a position such that the substrate mounting surface contacts the substrate within the recess.

14. The method of claim 13 wherein the support surface comprises a polishing pad.

15. The method of claim 14 further comprising loading the substrate against the polishing pad during polishing.

16. The method of claim 15 further comprising loading the retaining ring against the polishing pad during polishing.

17. The method of claim 13 wherein the support surface is located in a transfer station.

18. The method of claim 17 further comprising vacuum chucking the substrate to the carrier head and moving the carrier head to a polishing station.

19. The method of claim 17 further comprising vacuum-chucking the retaining ring to the carrier head and moving the carrier head to a polishing station.

20. The method of claim 13 wherein the substrate is centered by a tapered upper surface of the retaining ring as the substrate descends into the recess.

21. The method of claim 13 wherein moving the carrier head to a position such that the substrate mounting surface contacts the substrate includes positioning the retaining ring into a recess in the carrier head.

22. The method of claim 13 wherein positioning the substrate in the recess includes locating the substrate over the recess using a robot arm and releasing the substrate from the robot arm.

23. The method of claim 13 wherein releasing the retaining ring includes increasing a pressure in a chamber between the retaining ring and a housing to force the retaining ring from the carrier head.

24. The method of claim 13 wherein releasing the retaining ring includes discontinuing a vacuum-chucking operation which holds the retaining ring to the carrier head.

25. A chemical mechanical polishing apparatus, comprising:

a movable polishing pad;

a carrier head to position a substrate on the polishing pad, the carrier head including a housing, a substrate-receiving surface, a retaining ring positionable to surround the substrate-receiving surface, and a seal to engage the retaining ring to form a chamber between the housing and the retaining ring, the retaining ring being releasable and separable from the housing by control of a pressure in the chamber; and a drive shaft connected to the housing to rotate the carrier head.

26. The apparatus of claim 25 further comprising a pump fluidly connected to the chamber to control the pressure therein.

27. A carrier heads comprising:

a housing including a main body portion and a substantially annular flange portion surrounding the main body portion to define a recess, the main body portion having an outwardly-projecting annular rim;

a substrate-receiving surface;

a laterally movable retaining ring positionable in the recess so that the retaining ring surrounds the substrate-receiving surface and an inner surface of the retaining ring contacts the annular rim during polishing; and a seal to form a pressurizable chamber between the housing and the retaining ring.

28. The carrier head of claim 27 wherein the annular rim is adjacent an opening to the recess.

29. The carrier head of claim 27 wherein, during polishing, the annular rim is located sufficiently close to a polishing surface to reduce torque applied to the retaining ring.

30. A carrier heads comprising:

a housing;

a substrate-receiving surface;

a retaining ring positionable to surround the substrate-receiving surface and releasably securable to the housing; and a seal to form an evacuable chamber between the housing and the retaining ring when the retaining ring is secured to the housing, the retaining ring being separable from the housing by control of a pressure in the chamber.

31. A retaining ring, comprising:

a bottom surface to contact a polishing pad;

an inner surface to hold a substrate beneath a carrier head; and a tapered top surface including an inwardly sloped portion to guide the substrate into a recess defined by the inner surface and the polishing pad.

32. A carrier head, comprising:

a housing;

a substrate-receiving surface;

a retaining ring positionable to surround the substrate-receiving surface; and a seal to engage the retaining ring to form a pressurizable chamber between the housing and the retaining ring, the retaining ring being releasable and separable from the housing by control of a pressure in the chamber.

* * * * *